US012304726B2

(12) United States Patent
Pedretti-Rodi

(10) Patent No.: US 12,304,726 B2
(45) Date of Patent: May 20, 2025

(54) LIQUID STORAGE TANK AND METHOD OF PRODUCING THE SAME

(71) Applicant: Energy Vault, Inc., Westlake Village, CA (US)

(72) Inventor: Mauro Pedretti-Rodi, Canobbio (CH)

(73) Assignee: Energy Vault, Inc., Westlake Village, CA (US)

( * ) Notice: Subject to any disclaimer, the term of this patent is extended or adjusted under 35 U.S.C. 154(b) by 0 days.

(21) Appl. No.: 18/817,755

(22) Filed: Aug. 28, 2024

(65) Prior Publication Data

US 2024/0417161 A1 Dec. 19, 2024

(30) Foreign Application Priority Data

Sep. 11, 2023 (CH) ..... CH000992/2023

(51) Int. Cl.
*B65D 88/54* (2006.01)
*B65D 88/00* (2006.01)
*B65D 88/52* (2006.01)

(52) U.S. Cl.
CPC ..... *B65D 88/54* (2013.01); *B65D 88/005* (2013.01); *B65D 88/52* (2013.01)

(58) Field of Classification Search
CPC ..... B65D 88/54; B65D 88/005; B65D 88/52; F05B 2240/916; F05B 2280/4003; F05B 2280/5001; F03B 13/06
See application file for complete search history.

(56) References Cited

U.S. PATENT DOCUMENTS 2,552,119 A * 5/1951 Scharenberg ..... B64D 37/06 220/666
2,633,172 A 3/1953 Treiber
3,982,573 A * 9/1976 Jones ..... B65D 88/1656 206/524.5
4,592,492 A * 6/1986 Tidmore ..... B65D 1/0292 222/212
4,640,328 A 2/1987 Arney
5,447,110 A * 9/1995 Brown ..... B65D 1/0292 220/666

(Continued)

FOREIGN PATENT DOCUMENTS

WO WO 2023/173234 A1 9/2023
WO WO 2024/069221 A1 4/2024

OTHER PUBLICATIONS

International Search Report and Written Opinion dated Jan. 24, 2025 in related Application No. PCT/US2024/044278; 21 pages.

*Primary Examiner* — Kareen K Thomas
(74) *Attorney, Agent, or Firm* — Knobbe Martens Olson & Bear LLP

(57) ABSTRACT

A liquid storage tank with a storage unit has a flexible wall assembled from liquid-impermeable, flexible membrane sections. Due to their dimensions, these membrane sections give the liquid storage tank a predetermined operational shape when filled with the target amount of liquid. In the vertical operational position, this predetermined operational shape is drop-shaped, featuring an upper tip and a lower, bulged bottom area, where the tip is equipped with a supporting suspension for the storage unit, and a first liquid connection is provided in the bottom area. A method for manufacturing the liquid storage tank includes iterative calculations for the predetermined operational shape.

20 Claims, 11 Drawing Sheets

(56) References Cited

U.S. PATENT DOCUMENTS

| | | | | |
|---|---|---|---|---|
| 6,036,046 | A * | 3/2000 | Brambach | B60P 3/223 220/666 |
| 6,994,228 | B2 * | 2/2006 | Yoshihara | F15B 1/12 220/723 |
| 11,761,426 | B1 | 9/2023 | Stauffer | |
| 2002/0144503 | A1 | 10/2002 | Merswolke et al. | |
| 2003/0062290 | A1 | 4/2003 | Hunt | |
| 2004/0118855 | A1 * | 6/2004 | Calabro | F17C 1/00 220/560.08 |
| 2005/0017016 | A1 * | 1/2005 | Lombari | F24D 3/1008 220/721 |
| 2006/0131314 | A1 * | 6/2006 | Lombari | B29C 66/53262 220/721 |
| 2020/0198615 | A1 | 6/2020 | Novek | |
| 2023/0193871 | A1 | 6/2023 | Pedretti | |

* cited by examiner

LIQUID STORAGE TANK AND METHOD OF PRODUCING THE SAME

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

Field

The present disclosure is directed to a liquid storage tank, and more particularly to a vertically supported liquid storage tank with a flexible wall.

Description of the Related Art

Liquid storage tanks of various sizes can, in addition to storing liquids such as water for general use, be used for energy storage, for example in connection with pumped storage hydroelectric power plants.

Small amounts of water can be stored in small plastic containers, or in containers that have a flexible wall often made of a membrane. The individual membrane sections are cut and assembled such that the pattern of the membrane sections determines the shape of the filled liquid storage tank (e.g., when the liquid storage tank is emptied or partially emptied, the flexible wall collapses, and the liquid storage tank loses its shape).

Large liquid storage tanks can have a capacity of several cubic meters and are usually solid plastic or metal tanks. Such liquid storage tanks, including the work in constructing the foundation and manufacturing the liquid storage tanks are relatively inexpensive. However, when increasing the size of the storage tanks to be exceptionally (e.g., extremely) large, such extremely large liquid storage tanks are structurally complex and can increase the cost of operating a pumped storage power plant. Additionally, even when operating smaller pumped storage hydroelectric power plants, there are often problems in terms of location of such pumped storage power plants, which are typically located in mountainous regions and require land to be flattened on which to station liquid storage tanks.

SUMMARY

Accordingly, there is a need for the storage of liquids, such as water: on one hand, for the storage of several cubic meters to several hundred cubic meters decentralized, and on the other hand, centrally for the storage of larger amounts i.e., thousands or tens of thousands or more cubic meters, for example, for storing energy in the sense of pumped storage hydroelectric power plants. For example, with the spread of solar installations or local, small solar or wind power plants, local energy storage can be possible. In addition to the technically unresolved problems for energy storage, the infrastructure costs incurred today for such projects, both small and large, are very high.

In accordance with one aspect of the disclosure, a method for the production of a liquid storage tank and a liquid storage tank itself is provided. The liquid storage tank is simply designed and economically manufacturable, and at the same time scalable, so that small amounts of water of a few cubic meters as well as larger water volumes up to hundreds of thousands of cubic meters can be stored with low infrastructure costs, without requiring specific terrain conditions (e.g., without requiring modification of terrain, such as the flattening of land) to install the liquid storage tank(s).

In accordance with one aspect of the disclosure, the liquid storage tank has a flexible wall, which assumes a predetermined (e.g., stress-minimized) droplet shape when filled (e.g., fully filled) with the liquid. An optimal (e.g., uniform) stress distribution in the flexible wall is achieved, which advantageously avoids the very high stress peaks present in other tank forms with uneven stress distribution. Accordingly, the liquid storage tank can be made with less highly stressed, more economical, materials. In the case of storing larger amounts of liquid, such as several hundred cubic meters of water, the use of cheaper flexible walls (e.g., using more economical membrane materials) is thus made possible, as otherwise membrane materials to accommodate the forces applied to the flexible wall would not be available, or not available at economically justifiable costs. The iteration to achieve the optimal droplet shape for the liquid storage tank can be discontinued when the maximum stress has dropped to an acceptable threshold.

In accordance with another aspect of the disclosure, the flexible tension members further reduce the maximum stress in the flexible wall, with the corresponding advantages, including that the storage unit can be manufactured from even less stressed, thus more economical membrane sections. The costs of the number of tension members can be weighed against the material savings due to less stressed membrane sections to minimize the total costs for a storage unit given a target fill quantity, without needing to compromise on capacity as such or the reliability of the construction. Advantageously, the individual storage unit is not only easily scalable and simple to produce in various sizes but also can be manufactured in large quantities at low cost.

In accordance with one aspect of the disclosure, a liquid storage tank for use in an energy storage system is provided. The liquid storage tank includes a storage unit operable to expand into a droplet shape when filled with a liquid. The storage unit can include a flexible wall of a liquid impermeable material assembled from a plurality of membrane sections. The liquid storage tank can include a vertical support post coupled to a tip of the flexible wall with an upper attachment ring and coupled to a bottom area of the flexible wall with a lower attachment ring. The upper attachment ring and the lower attachment ring can form a fluid tight seal between the flexible wall and the vertical support post. The flexible wall can extend symmetrically about the vertical support post. The liquid storage tank can include a first liquid connection port positioned on the flexible wall and proximate to the bottom area. The first liquid connection port can be in fluid communication with an interior volume of the storage unit and can be operable to allow the liquid to flow out of the storage unit. A second liquid connection port can be positioned on the flexible wall and proximate to the tip. The second liquid connection port can be in fluid communication with the interior volume of the storage unit and operable to allow the liquid to flow into the storage unit. An air connection port can be positioned on the flexible wall. The air connection port can be in fluid communication with the interior volume of the storage unit and operable to receive a flow of air therethrough to maintain the flexible wall in an expanded condition as the liquid is withdrawn from the storage unit. The liquid storage tank can include one or more flexible tension members positioned on an outer surface of the flexible wall and extending from the tip to the bottom area. The one or more flexible tension members can be operable to exert a pressure along a line of contact between the one or more flexible tension members and the flexible wall to reduce an amount of stress exerted on the flexible wall by the liquid within the storage unit.

In accordance with one aspect of the disclosure, a liquid storage tank for use in an energy storage system is provided. The liquid storage tank can include a storage unit operable to expand into a droplet shape when filled with a liquid, the storage unit including a flexible wall of a liquid impermeable material assembled from a plurality of membrane sections. Additionally, the liquid storage tank can include a vertical support post coupled to a tip of the flexible wall with an upper attachment ring and coupled to a bottom area of the flexible wall with a lower attachment ring. The upper attachment ring and the lower attachment ring can form a fluid tight seal between the flexible wall and the vertical support post. The flexible wall can extend symmetrically about the vertical support post. A first liquid connection port can be positioned on the flexible wall and can be proximate to the bottom area. The first liquid connection port can be in fluid communication with an interior volume of the storage unit and operable to allow the liquid to flow out of the storage unit. A second liquid connection port can be positioned on the flexible wall and proximate to the tip. The second liquid connection port can be in fluid communication with the interior volume of the storage unit and can be operable to allow the liquid to flow into the storage unit. Furthermore, an air connection port can be in fluid communication with the interior volume of the storage unit and operable to receive a flow of air therethrough to maintain the flexible wall in an expanded condition as the liquid is withdrawn from the storage unit.

In accordance with one aspect of the disclosure, a liquid storage tank for use in an energy storage system is provided. The liquid storage tank can include a storage unit operable to expand into a droplet shape when filled with a liquid. The storage unit can include a flexible wall of a liquid impermeable material. Additionally, the liquid storage tank can include a vertical support post coupled to a tip of the flexible wall and coupled to a bottom area of the flexible wall forming a fluid tight seal between the flexible wall and the vertical support post. The flexible wall can extend symmetrically about the vertical support post. The liquid connection port can be in fluid communication with an interior volume of the storage unit and operable to allow the liquid to flow out of the storage unit and can be operable to allow the liquid to flow into the storage unit. Furthermore, the liquid storage tank can include an air connection port which can be in fluid communication with the interior volume of the storage unit and which can receive a flow of air therethrough to maintain the flexible wall in an expanded condition as the liquid is withdrawn from the storage unit.

In accordance with one aspect of the disclosure, a liquid storage tank for use in an energy storage system is provided. The liquid storage tank can include one or more storage units which can expand into a droplet shape when filled with a liquid. The one or more storage units can include a flexible wall made of a liquid impermeable material. The one or more storage units can include a vertical support post coupled to a tip of the flexible wall and coupled to a bottom area of the flexible wall forming a fluid tight seal between the flexible wall and the vertical support post. The flexible wall can extend symmetrically about the vertical support post. The one or more storage units can include one or more liquid connection ports being in fluid communication with an interior volume of the one or more storage units and which can allow the liquid to flow out of the one or more storage units and which can allow the liquid to flow into the one or more storage units. The one or more storage units can include an air connection port in fluid communication with the interior volume of the one or more storage units and which can receive a flow of air therethrough to maintain the flexible wall in an expanded condition as the liquid is withdrawn from the one or more storage units. Additionally, a group of the one or more storage units can be fluidly coupled to a conduit. The conduit can extend between the one or more liquid connection ports and a pump turbine. The pump turbine can pump the liquid through the conduit and to the group of the one or more storage units through the one or more liquid connection ports. Additionally, the group of the one or more storage units can be operable to deliver the liquid contained within the group of the one or more storage units though the conduit and to the pump turbine to generate electricity.

In accordance with one aspect of the disclosure, a method for storing energy with liquid storage tanks is provided. The method can include storing an amount of energy by pumping a liquid from a lower elevation to a higher elevation through a conduit hydraulically coupled to one or more storage units of one or more liquid storage tanks via liquid connection ports in communication with an interior volume of the one or more storage units. The method can also include storing an amount of energy by filling a flexible wall of the one or more storage units with the liquid to store an amount of energy as potential energy. The flexible wall can be operable to expand and form a droplet shape when filled with the liquid. The method can also include generating an amount of electricity by withdrawing an amount of the liquid from the one or more storage units via the liquid connection ports and flowing the liquid through the conduit away from the one or more storage units to the lower elevation under force of gravity. The method can also include generating an amount of energy by rotating a turbine with the liquid flowing through the conduit to generate the amount of electricity.

DETAILED DESCRIPTION

Figure 1:
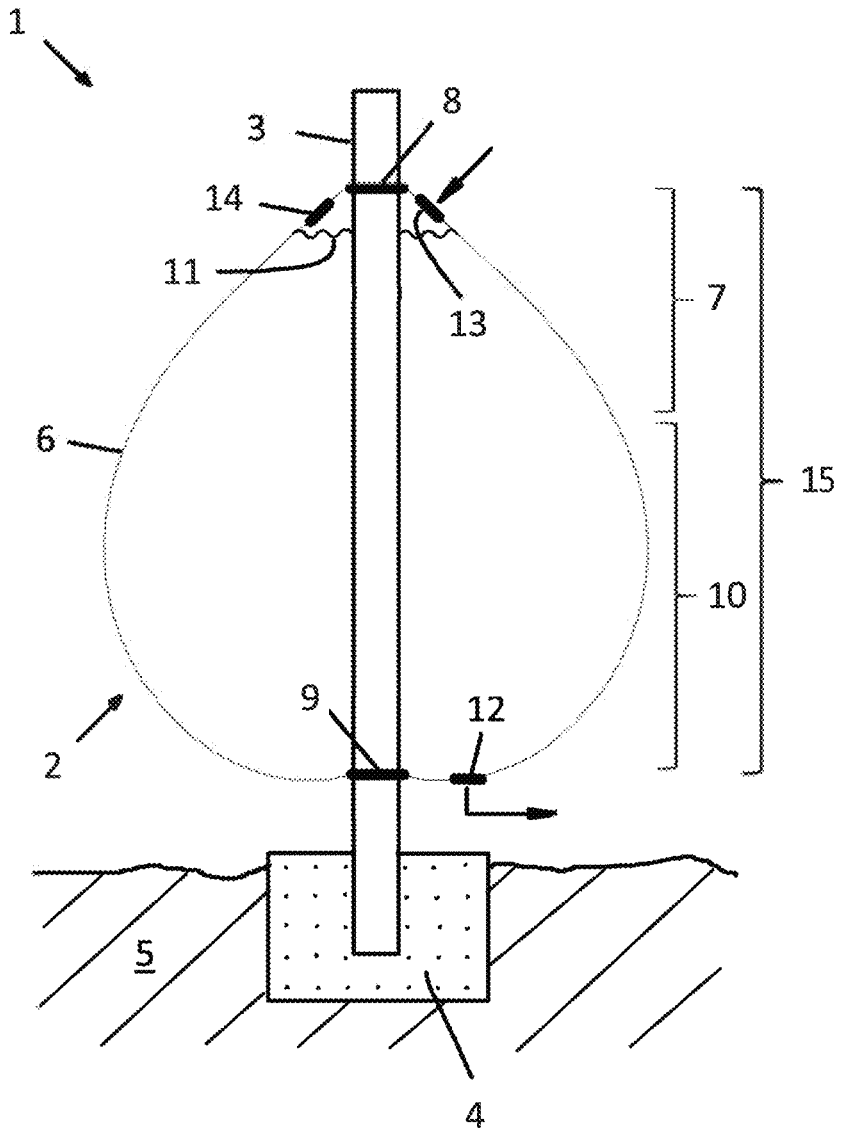
FIG. 1 shows a schematic cross-sectional side view of a liquid storage tank.

FIG. 1 shows a schematic cross-sectional side view of a liquid storage tank 1. The liquid storage tank 1 includes a storage unit 2, which is suspended from a vertical central support 3 (e.g., post, hollow cylindrical post) that is anchored in the ground 5 via a foundation 4 (e.g., a concrete foundation). The storage unit 2 is supported in a vertical orientation (e.g., longitudinally), where the vertical orientation corresponds to the storage unit 2 extending from the tip or the upper end or region 7 of the storage unit 2 to the bottom area or bulging bottom area or bottom end or region 10 of the storage unit 2. The storage unit 2 is designed to carry the weight of the liquid 11 filling the storage unit 2. The storage unit 2 has a flexible wall 6, which in some examples can be assembled from multiple membrane sections (not shown), and the flexible wall 6 of the storage unit 2 can be filled with a target or desired amount of liquid 11. Filling the storage unit 2, in addition to the cut pattern of the membrane sections of the flexible wall 6, gives the storage unit 2 a drop-shaped (e.g., water droplet shape) and rotationally symmetrical form about a central axis (e.g., Z-axis) of the vertical central support 3. The membrane sections are impermeable (e.g., water resistant) and can inhibit (e.g., prevent) the liquid 11 from escaping or permeating through the flexible wall 6 of the storage unit 2. In one example, the liquid 11 can be water. However, in other examples, the liquid 11 can also be any other suitable liquid, depending on storage needs.

The storage unit 2 is shaped similarly to a water droplet (e.g., a water droplet that is about to detach itself from the tap or water faucet) and the storage unit 2 has a nearly uniform surface tension (e.g., the tension along individual sections of the flexible wall 6 is substantially the same or uniform). The droplet shape (e.g., predetermined operational shape) of the filled storage unit 2 can lead to a highly uniform stress distribution in the flexible wall 6 (e.g., the stress at different, individual sections or portions of the flexible wall 6 is substantially the same or uniform). The droplet shape of the storage unit 2 advantageously avoids creating areas or regions with comparatively excessive tension (e.g., one section of the flexible wall 6 with significantly higher tension than another section), which allows for the use of a membrane material without a correspondingly high strength (e.g., a lower strength membrane material). Advantageously, using a membrane material with a lower strength can lead to considerable material and cost savings. However, a highly uniform stress distribution does not mean that only one stress value exists, but rather that in the areas of the flexible wall 6 experiencing the greatest amount of stress due to the liquid pressure have stress values which lie within a narrow interval or window (e.g., a narrow interval or window when compared to the stress values themselves, see FIGS. 3*a* and 3*b*). The width or range of the stress value interval depends, for example, on how many iteration steps are performed when calculating the droplet shape of the storage unit 2, the tolerances in the manufacture of the storage unit 2, and the quality (e.g., uniformity) of the material (see the description below).

The storage unit 2 is suspended at its top (e.g., a topmost portion) at a point or a region 7 on the central support 3 via an upper attachment ring 8. The upper attachment ring 8 secures (e.g., fixes, couples) the storage unit 2 to the central support 3, where the flexible wall 6 is operatively attached (e.g., the flexible wall 6 is connected to the central support via the upper attachment ring 8 and extends from the central support 3). A lower attachment ring 9 is also fixed to the central support 3. The lower attachment ring 9 is operatively connected at the bottom of the storage unit 2 at the bulged bottom area 10. Advantageously, the lower attachment ring 9 can be suitably designed to attach to the bulged bottom area 10, where the bulged bottom area 10 can be various sizes and configurations (e.g., different widths or circumferences in a horizontal direction). In one implementation, coupling the storage unit 2 to the central support 3 with the upper and lower attachment rings 8, 9 can suspend the storage unit 2 at its tip or at point or region 7. The upper attachment ring 8 and lower attachment ring 9 can form a fluid-tight seal with the flexible wall 2 and to the central support 3. In some examples, a hose (not shown) can extend from the upper attachment ring 8 to the lower ring 9 and encompass the central support 3. Additionally, the central support 3 could be removed and the storage unit 2 can instead be supported by an external frame (not shown) at its tip or at a region 7. Advantageously, by coupling the storage unit 2 to the central support 3 with the upper attachment ring 8 and the lower attachment ring 9, the storage unit 2 does not swing (e.g., the storage unit 2 is not suspended like a pendulum). Additionally, connecting the storage unit 2 to the central support 3 with the upper attachment ring 8 and the lower attachment ring 9 can reduce the complexity of assembling the liquid storage tank 1 and can lead to significant cost savings in manufacturing and assembly of the liquid storage tank 1. Furthermore, the liquid storage tank 1 can be assembled over common and inexpensive foundations 4 (e.g., concrete, reinforced concrete) in the ground 5. Advantageously, by suspending the storage unit 2 on the central support 3 and between the upper attachment ring 8 and the lower attachment ring 9, the storage unit 2 can carry the weight of the desired or target (e.g., optimized) amount of liquid 11 (e.g., water) to fill the storage unit. Additionally, the central support 3 is arranged in the storage unit 2 such that it penetrates (e.g., extends through) the unit from the tip or region 7 to the bottom area 10 through its entire height 15. Additionally, suspending the storage unit 2 on the central support 3 via the upper attachment ring 8 and the lower attachment ring 9 allows for the liquid storage tank 1 to be assembled at a central location (e.g., a factory) and shipped in an assembled state to the location for installation, simplifying and reducing the cost of the installation process for the liquid storage tank(s) 1.

FIG. 1 also shows a first liquid connection 12 which can allow liquid 11 to evacuate (e.g., be withdrawn from, flow out of) the storage unit 2. A second liquid connection 13 can allow liquid 11 to flow into (e.g., fill) the storage unit 2 (as symbolized by the arrows at the first and second connections 12,13). The first liquid connection 12 can be located at or adjacent to the bottom area or bulging bottom area 10. The second liquid connection 13 can be located at or adjacent to the tip or the region 7. A connection 14 for a blower (see FIG. 8) can be positioned at or adjacent to the tip or the region 7. The connection 14 can allow a blower (e.g., air source) to inflate the storage unit 2 when liquid 11 is being withdrawn (e.g., flowing out of, evacuating) the storage unit 2, which inhibits (e.g., prevents) the flexible wall 6 from collapsing (e.g., sagging, falling toward the ground 5) and allows the flexible wall 6 to maintain a droplet shape and continue to allow withdrawal of liquid from the storage unit 2 as the liquid level in the storage unit 2 decreases, advantageously allowing all or substantially all of the liquid in the storage unit 2 to be withdrawn. Advantageously, providing air with the blower or air source at the connection 14 can inhibit (e.g., prevent) the storage unit 2 from collapsing under certain conditions (e.g., windy conditions). Additionally, in some implementations, the first and second liquid connections 12, 13 do not have to be positioned in separate locations (e.g., at or near the tip or region 7, at or near the bottom area or bulging bottom area 10) but can be positioned in one location (e.g., only at or near the tip or the region 7, only at or near the bulging bottom area 10) so that there is only a single two-way liquid connection.

The flexible wall 6 can be made from any suitable, elastic material such as a PVC-coated polymer fabric. Additionally the elastic material of the flexible wall 6 can also be Kevlar®-reinforced (e.g., reinforced with poly-p-para-phenylene therephthalamide). Additionally, the flexible wall 6 can be made from a metal fabric having a coating (e.g., liquid-tight coating), where the coating can consist of polyurethane, neoprene, or other suitable materials. In some implementations, the materials used for the flexible wall 6 are provided as flat sheets and must be appropriately cut (e.g., cut to the required size) and assembled for a desired 3D shape (e.g., the droplet shape shown in FIG. 1). Accordingly, once the 3D shape (e.g., the droplet shape) of the storage unit 2 is determined, membrane sections are cut from a flat membrane or flat sheets and then assembled to form the 3D shape. The outlines or shape of the membrane sections cut from the flat membrane can form the pattern of the membrane sections.

The shape (e.g., droplet shape) of the storage unit 2 can be determined (e.g., calculated) numerically by using the Finite Element Method as follows: For a specific target amount of liquid, a basic body made of the selected membrane material with the corresponding capacity is assumed, which may be a sphere, or a body composed of an upper cone and a lower spherical section. One of skill in the art can use a variety of shapes, such as the basic body with a droplet-like shape, which can result in fewer subsequent iteration steps. Computationally, this basic body is filled with the intended target amount of liquid, resulting in a shape of the filled basic body, which can be a first intermediate operational shape of the liquid storage tank 1. The basic body is considered to be an "intermediate operational shape" because this form is further modified by repeating this step iteratively. Once the first intermediate operational shape is known, the stress distribution in the flexible wall can again be numerically determined ("first intermediate stress distribution"), especially its highest values.

This calculation for the shape of the storage unit 2 is repeated (e.g., iterated), but now the first intermediate operational shape is computationally filled with liquid, resulting in a change to the second intermediate operational shape. The calculation of the second intermediate stress distribution in the second intermediate operational shape results in lower maximum stress values in the flexible wall 6. Advantageously, selecting a favorable basic shape such as a sphere (instead of a complex basic shape, such as an hourglass) can result in a lower maximum stress value in the flexible wall 6.

A third iteration step results in a third intermediate operational shape with further reduced maximum stresses in the flexible wall, with the operational shape increasingly approaching the desired droplet shape. Additional iteration steps can be envisaged (e.g., implemented) as needed, where further iteration steps can show a reduction of the maximum stress values in the flexible wall 6 (e.g., the stress values become smaller as the number of iteration steps increases). The iterations can be terminated once the reduction in maximum stress values is satisfactory. For example, the reduction in maximum stress values may be satisfactory when they fall below the tensile strength of a planned or possible membrane material, or when the reduction itself is so small in magnitude that further iteration is no longer worthwhile (e.g., the iteration is terminated as soon as the maximum stress in the flexible wall has dropped to an acceptable threshold). The acceptable threshold can be determined from the strength (e.g., tensile strength and safety) of a membrane material (e.g., a PVC-coated polymer fabric, such as PVC-coated polyester fabric, having a tensile strength of 160 kN/m) or, for example, when changes in each further iteration are too small and thus no longer lead to meaningful reductions of maximum stress. The acceptable threshold may occur when the intended (cost-effective) production of the storage unit 2 results in tolerances in the finished storage unit 2 with deviations from the predetermined operational shape that are coarser than the further refinement of the predetermined operational shape, therefore making further reduction of the maximum stress values no longer meaningful.

Although the predetermined operational shape (e.g., droplet shape) results from the suspension of the storage unit 2 at its tip or region 7 (see FIG. 1), it is not required that the tip or region 7 where the storage unit is suspended from receives the full weight of the filled storage unit 2 (e.g., the vertical load experienced at the tip or region 7 is not necessarily the entire weight or vertical force exerted by the liquid 11 and storage unit 2). Having the tip or region 7 experience the entire vertical load could require a high number of iterations (e.g., iterative steps) and could require highly precise manufacturing, which can be costly and uneconomical. Therefore, one of skill in the art may also provide, during in the calculation process, that a lower suspension point (see FIG. 1, the lower attachment ring 9) takes on a portion of the total weight (e.g., weight of liquid 11), which can be 10% or less of the total weight.

During calculations, one of skill in the art should note that fiber-reinforced membrane materials (e.g., the materials used in the flexible wall 6) often have anisotropic properties. In some implementations, when conducting numerical calculations for materials with anisotropic properties, the modulus of elasticity of the material must be set in several different directions (e.g., X-direction, Y-direction, and/or Z-direction). Further, it should be noted that the calculation of the predetermined operational shape generally leads to rotational symmetry. Although the predetermined operational shape can deviate from rotational symmetry in some cases, this deviation leads to increased maximum values in the stress distribution of the flexible wall 6. Ultimately, determining the pattern for cutting the membrane sections can be iterative and time consuming, and can also be done through calculation or even on a physical model of the predetermined operational shape, by laying sections of the material sheet on and optimizing their cut lines on the physical model.

A method for producing a liquid storage tank 1 with a storage unit 2 that has a flexible wall 6 can include a flexible wall 6 assembled from individual liquid-impermeable, flexible membrane sections that give the storage unit 2 a predetermined operational shape upon being filled with the target amount of liquid 11. The predetermined operational shape can be a vertically oriented droplet shape featuring an upper tip or region 7 and a lower, bulged bottom area 10. The predetermined operational shape (e.g., droplet shape) is iteratively determined step-by-step from a basic body enclosing a volume and based on the hydrostatic pressure of a liquid 11 to be stored and material properties of the membrane material. After each iteratively determined intermediate operational shape, the maximum stress in the flexible wall 6 under hydrostatic pressure is determined, and the iteration is terminated as soon as the maximum stress drops to an acceptable threshold. After a determined shape is iteratively calculated, (based on the predetermined operational shape), a cutting pattern from flexible membrane sections is created such that when the membrane sections are assembled, the flexible wall 6 of the storage unit 2 is formed. After the storage unit 2 is filled with the target amount of liquid 11, the storage unit 2 has the predetermined operational shape.

Additionally, a liquid storage tank 1 with a storage unit 2 that has a flexible wall 6 assembled from liquid-impermeable, flexible membrane sections can be formed where the dimensions of the membrane sections can give the liquid storage tank 1 an operational shape (e.g., droplet shape) when filled with the target amount of liquid 11. The predetermined operational shape is drop-shaped in vertical operational position, with an upper tip or region 7 and a lower, bulged bottom area 10, where the tip 7 is provided with a supporting suspension (e.g., central support 3) for the storage unit 2, and a first liquid connection 12 is provided in the bottom area.

Figure 2A:
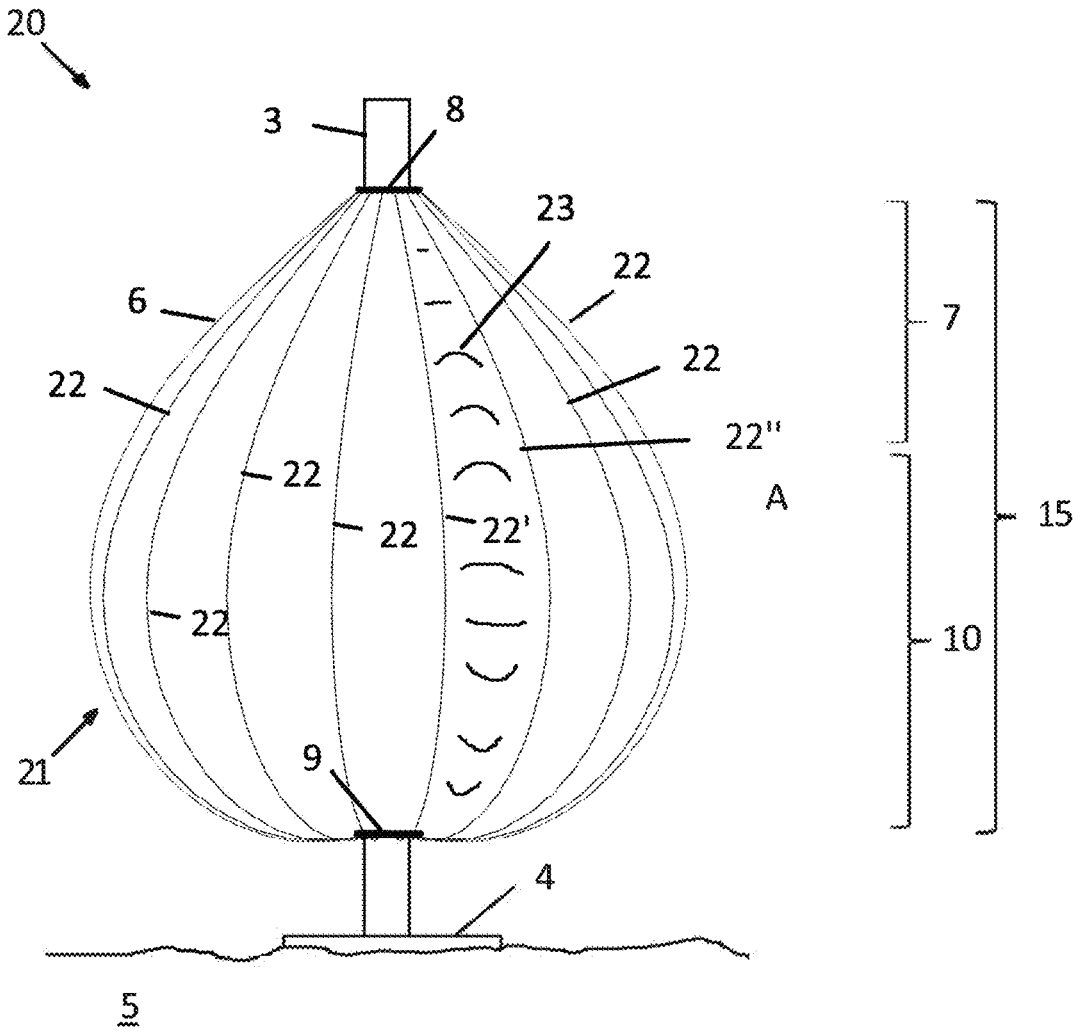
FIG. 2*a* shows a schematic side view of another embodiment of a liquid storage tank.

FIG. 2*a* shows a liquid storage tank 20 filled with the target amount of liquid featuring a modified storage unit 21, equipped with several flexible tension members 22, 22', 22" which extend from the tip or the region 7 (the upper attachment ring 8) to the center of the bottom area 10 (the lower attachment ring 9), where the flexible tension members 22, 22', 22" are attached and press against the flexible wall 6. The tension members 22, 22', 22" exert pressure along their entire length and along their contact line on the flexible wall 6 and can slightly indent into the flexible wall 6 (e.g., exerting a pressure or force on the flexible wall 6). Depending on the specific design of the predetermined operational shape of the storage unit 21 (number of iteration steps, manufacturing tolerances), it is possible that the flexible tension members 22, 22', 22" near the upper attachment ring 8 or near the lower attachment ring 9 exert little or no pressure on the flexible wall 6 (e.g., creating no or little indent on the flexible wall 6). Additionally, the flexible tension members 22, 22', and 22" can exert pressure at least over a section of their contact line on the flexible wall 6 and thereby constrict the flexible wall 6 such that vertically extending ridges 23 form between two tension members 22 and along the flexible wall 6. As shown in FIG. 2*a*, ridges 23 are formed between the tension members 22' and 22". The tension members 22, 22', and 22'" can be cables or ropes of any kind.

Figure 2B:
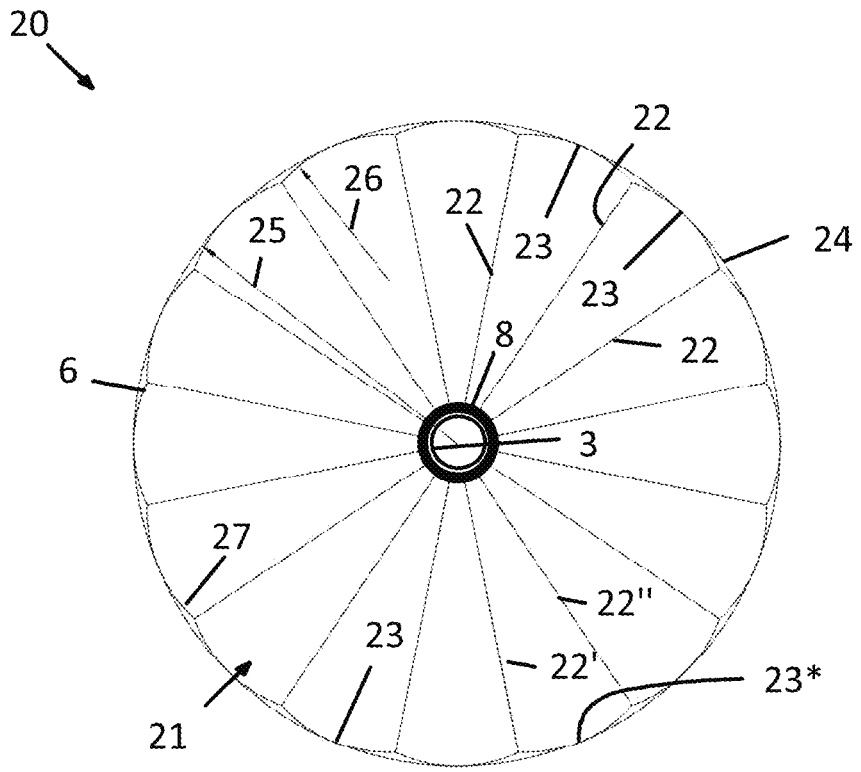
FIG. 2*b* shows a schematic top view of the liquid storage tank in FIG. 2*a*.

FIG. 2*b* shows a top view of the liquid storage tank 20, where a circumference line 24 is placed around the largest diameter of the storage unit 21. The circumference line 24 which shows the round cross-sectional shape of the flexible wall 6, if no tension members 22, 22', 22" are positioned along the flexible wall 6. The circumference line 24 has the curvature radius 25. Each ridge 23 has the curvature radius 26, to which an arc segment 27 of the ridge 23 belongs. The arc segment 27 extends between two of the tension members 22, 22', 22". The curvature radius 26 of a ridge 23 is smaller than the curvature radius 25 of the circumference line 24, (i.e., the flexible wall without the tension members 22, 22', 22"). Liquid storage tanks 1, 20 (as shown in FIGS. 1-2*b*) are also suitable to be interconnected and can be arranged or positioned in groups for storing large or very large amounts of liquid (See FIGS. 4*a* and 4*b*, below).

The stress σ in the flexible wall 6 depends on the pressure inside the storage unit 21 and its curvature. In cylindrical bodies, the relationship $\sigma=p*R/t$ applies, where p is the pressure differential relative to the ambient pressure, R is the curvature radius, and t is the thickness of the membrane material of the flexible wall 6. In spherical bodies, the relationship$=\sigma*R/(2*t)$ applies. The stress σ in the flexible wall 6 in the circumferential or longitudinal direction can be determined by $p=\sigma_1/(t*R_1)+\sigma_2/(t*R_2)$, where $\sigma_1$ is the longitudinal or meridional stress along the flexible wall 6, $\sigma_2$ is the circumferential (e.g., hoop) stress along the flexible wall 6, $R_1$ is the first curvature radius (e.g., curvature radius 25), and $R_2$ is the second curvature radius (e.g., curvature radius 26). The stress at any point on the flexible membrane 6 can be determined in two directions lying on a tangential plane at that point (e.g., X-direction, Y-direction). These two directions can form based on an intersection of the tangential plane with a horizontal plane (X-direction) and based on an intersection of the tangential plane with a vertical plane (Y-direction). The internal pressure in the storage unit 21, remains the same with or without tension members 22, 22', 22". However, the curvature radius in the X-direction in an arc segment 27 is smaller than the circumference line 24 (e.g., radius of the circumference line 24) when tension members 22, 22', 22" are placed on the storage unit 21. Having the curvature radius in the X-direction of the arc segment 27 be smaller than the circumference line 24 can cause the stress in the X-direction ox in a ridge 23 formed by the tension members 22 to be lower than stress in the X-direction without such any ridge along the flexible wall 6. Advantageously, the tension members 22 cause a deformation of the flexible wall 6 such that the stress prevailing in it in the X-direction is reduced.

The flexible wall 6 of the storage unit 21 can, in some implementations, have an additional number of flexible, cooperating tension members 22, 22', 22", which after filling with the target amount of liquid extend along their outside and in contact with it from the tip 7 to the center of the bottom area 10, and are spaced equally around the circumference 24 of the predetermined operational shape (e.g., droplet shape) of the storage unit 21, constricting the flexible wall 6 so that it forms vertically extending ridges between each pair of tension members.

The predetermined operational shape of the storage unit 21 equipped with tension members 22, 22', 22" can be similar to the storage unit 2 without tension members 22. Additionally, a basic body equipped with tension members 22, 22', 22" is used (e.g., during iterative calculations), and the intermediate operational shape is determined iteratively with the help of the material properties of the tension members 22, 22', 22" (especially the modulus of elasticity of the tension members). For example, including a number of flexible tension members 22, 22', 22" (along with the flexible tension members 22, 22', 22" material properties and length) cooperating with the flexible wall 6 (after filling the storage unit 2 with the target amount of liquid) and extending along the outside of and contacting the storage unit 2 from the tip or region 7 to the center of the bottom area 10, which exert pressure at least over a section of the contact line, and spacing them equally around the circumference of the predetermined operational shape of the storage unit can help iteratively calculate the predetermined operational shape.

The achieved reduction in stress can be targeted towards the strength values of a desired membrane material or another purpose. For the stress reduction, the length of the tension members 22, 22' 22" can affect performance of the storage unit 2. The shorter the tension members 22, 22' 22"

are, the more the tension members 22, 22' 22" cut into the flexible wall 6 and thus produce a stronger curvature 27. Additionally, increasing the number of tension members 22, 22' 22" can cause the tension members 22, 22', and 22" to cut into the flexible wall 6 and thus produce a stronger curvature 27 since a smaller distance between adjacent tension members 22, 22', and 22" has the same effect.

The degree of stress reduction can, for example, be directed towards using a membrane material with lower strength that is more cost-effective. In contrast, the costs for manufacturing the storage unit 21 with a larger number of tension members 22, 22', 22" will increase. One of skill in the art can determine a predetermined reduction of the maximum stress in the flexible wall 6 and determine the number and length of the tension members 22, 22', 22" accordingly. The number of tension members 22, 22', 22" and their respective length are determined with a view to a predetermined reduction of the maximum stress in the flexible wall 6. In some embodiments, the smallest curvature radius of the ridges 23 (over the height of the ridge 23) is <70%. In some embodiments, the smallest curvature radius of the ridges 23 (over the height of the ridge 23) is <60%. In some embodiments, the smallest curvature radius of the ridges 23 (over the height of the ridge 23) is <50%. In some embodiments, the smallest curvature radius of the ridges 23 (over the height of the ridge 23) is <40%. In some embodiments, the smallest curvature radius of the ridges 23 (over the height of the ridge 23) is <30% of the curvature radius of the circumference line 24 laid at the corresponding location around the circumference. Since the storage unit 21 can have a droplet shape, the curvature radius of the ridge 23 measured at its ends at the upper and lower attachment rings 8, 9 can be relatively large and can approximately correspond to the curvature radius of the local circumference line 24, while the curvature radius decreases from the ends until it reaches a minimum at a location on the ridge 23.

Figure 3A:
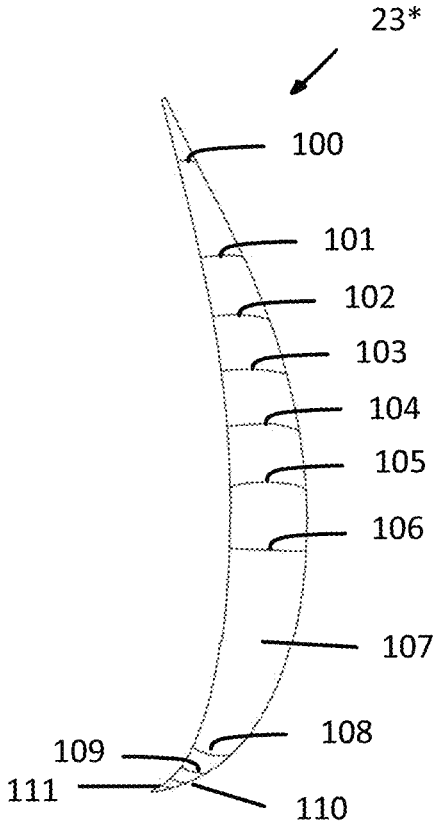
FIG. 3*a* shows a stress distribution in the flexible wall of the liquid storage tank according to FIG. 2*a* and FIG. 2*b*.
Figure 3B:
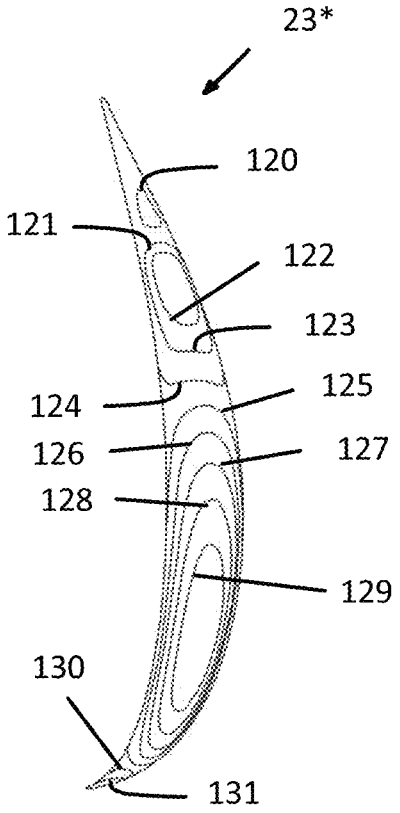
FIG. 3*b* shows a stress distribution in the flexible wall of the liquid storage tank according to FIG. 2*a* and FIG. 2*b*.

FIGS. 3*a* and 3*b* show the stress distribution on a ridge 23*. FIG. 3*a* shows the stress distribution on a ridge 23* in the X-direction and FIG. 3*b* shows the stress distribution of the ridge 23* in the Y-direction. The respective stresses are indicated on iso-lines, thus having the same value on these lines.

This stress distribution is calculated with the ANSYS Mechanical software by Ansys, Inc., as described above, with three iterative steps. In some examples, the stress distribution is calculated assuming water is the liquid 11 and the target amount of liquid 11 of 560 $m^3$. The textile membrane that can be used in the stress distribution calculation is Flexlight Advanced 1502 by the Serge Ferrari Group which can have a thickness of 1 mm. When calculating the stress distribution, the modulus of elasticity in the x-direction of the membrane (e.g., Flexlight Advanced 1502 by the Serge Ferrari Group) is 5510 MPa, and the modulus of elasticity of the membrane in the y-direction it is 2300 MPa. The membrane (e.g., Flexlight Advanced 1502 by the Serge Ferrari Group) can have a maximum tensile strength in the x-direction of 200 MPa, and in the y-direction of 160 MPa. During calculation, the flexible tension members 22 can be, for example, 16 steel cables with an elastic modulus of 160 MPa, a diameter of 24 mm, and a breaking load of 355 kN.

The iteration, as described above, resulted in the predetermined operational shape depicted in FIGS. 2*a* and 2*b*, with the steel cables loaded with a tension of 345 kN, the weight taken by the upper attachment ring 8 being 5,300 kN, and the weight taken by the lower attachment ring 9 being 300 kN.

The calculated stresses have the following values:

| FIG. 3a: Iso-line | σ in MPa | FIG. 3b: Iso-line | σ in MPa |
|---|---|---|---|
| 100 | 2 | 120 | 26 |
| 101 | 11 | 121 | 21 |
| 102 | 19 | 122 | 17 |
| 103 | 27 | 123 | 26 |
| 104 | 36 | 124 | 30 |
| 105 | 44 | 125 | 35 |
| 106 | 52 | 126 | 40 |
| 107 | 65* | 127 | 44 |
| 108 | 52 | 128 | 48 |
| 109 | 44 | 129 | 54* |
| 110 | 36 | 130 | 26 |
| 111 | 19 | 131 | 21 |

The stress values marked with a * are maximum values, where an arrow instead of an iso-line is drawn in the figures to mark the location of the maximum value.

Advantageously, the stress values show, for example, that a liquid storage tank for or able to contain 560 tons of water with a flexible membrane (e.g., flexible wall 6) is feasible at low cost (e.g., low cost or inexpensive membrane(s), cables, manufacturing). This is also true for even larger or smaller liquid storage tanks.

Figure 4A:
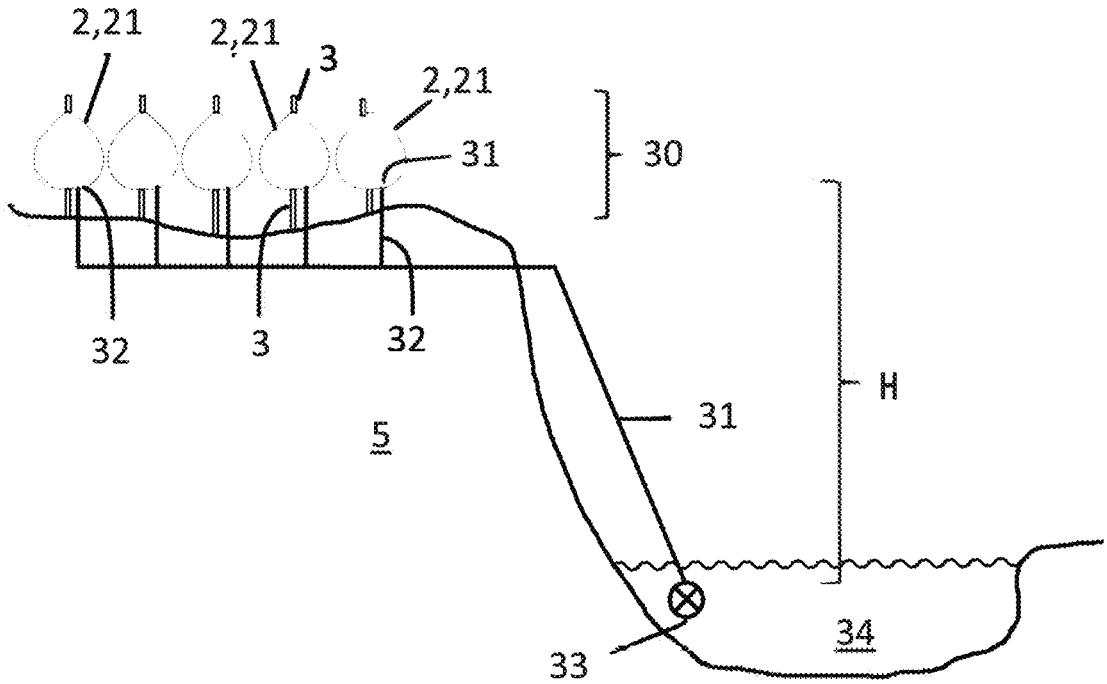
FIG. 4*a* shows a schematic view of an arrangement of liquid storage tanks.

FIG. 4*a* shows a group of liquid storage tanks 30 formed from liquid storage tanks 1, 20 (see FIG. 4*b*), where the individual storage units 2, 21 are positioned side by side on the ground 5 of a hill. A conduit arrangement 31 can be connected (e.g., coupled to) one or more two-way liquid connections 32 (see the previous disclosure and FIG. 1), where one or more two-way liquid connections 32 can be connected to each storage unit 2, 21 so that each of the storage units 2, 21 can be filled and emptied via the conduit arrangement 31. The conduit arrangement 31 connects the storage units 2, 21 with a pump turbine 33 in a body of water 34 (basin, river, lake, sea). In one more of operation (e.g., as a pumped storage hydroelectric power plant), water can be pumped from the body of water 34 by the pump (of the pump turbine 33) and into the storage units 2, 21 using energy (e.g., electrical energy, solar energy) to store water in the storage units 2, 21 and therefore store energy corresponding to the potential energy of the water in the storage units 2, 21 on the ground 5 of the hill relative to the elevation H of the body of water 34 that is below the storage units 2, 21. In another mode of operation, the water can be released from the storage units 2, 21 and back into the body of water 34, where the turbine (of the pump turbine 33) driven by the pump (of the pump turbine 33) recovers energy (e.g., generates electricity). It should be noted that one of skill in the art can provide a storage unit 2, 21 without tension members 22 and/or a storage unit 2, 21 with tension members 22. Additionally, the group of liquid storage tanks 30 can include a combination of storage units 2, 21 where one or more of the storage units 2, 21 are differently sized from the other storage units 2, 21 in the group of liquid storage tanks 30.

In some implementations, a method for generating energy can include the group of liquid storage tanks 30 which include several storage units 2, 21. The storage units 2, 21 can be filled and emptied via a common conduit arrangement 31. The group of liquid storage tanks 30 can also have at least two storage units 2, 21 and a common conduit arrangement 31, where the common conduit arrangement 31 can be operably connected to the storage units 2, 21 in order to fill and empty the storage units 2, 21 (e.g., simultaneously). Additionally, a pump turbine 33 can be placed in the body of water 34, where the conduit arrangement 31 can be operatively connected to a pump (of the pump turbine 33) and to the first liquid connection 12 (see e.g., FIG. 1) and the turbine (of the pump turbine 33) can be operatively connected to the second liquid connection 13. The arrangement of devices and/or systems (e.g., turbine, pump) on the group of liquid storage tanks or connected to the common conduit arrangement can be modular.

The storage unit 2, 21 can have in the bottom area thereof a first liquid connection 12 operatively connected to the conduit arrangement 31. The conduit arrangement 31 can connect the first liquid connection 12 to a turbine, such that the storage unit 2, 21 can be emptied via the turbine (e.g., the liquid can be pumped from the storage unit 2, 21). The storage unit 2, 21 can include a second liquid connection 13 and the conduit arrangement 31, where the conduit arrangement 31 can be operatively connect the liquid connection 13 to a pump, such that the storage unit 2, 21 of the liquid storage tanks 30 can be filled via the pump. The turbine and the pump can be designed as a pump turbine 33. The first and the second liquid connections 12, 13 can be coupled to the two-way connection 32. The liquid storage tank 2, 21 can further include a conduit arrangement 31 and a turbine, where the conduit arrangement 31 connects the first liquid connection 12 with the turbine. Additionally, the storage unit 2, 21 can be equipped with (e.g., coupled to) a second liquid connection 13 and a conduit arrangement 31, where the conduit arraignment 31 operatively connects the second liquid connection 13 with a pump, such that the storage unit 2, 21 can be filled via the pump. In some implementations, the first and second liquid connections 12, 13 are a single two-way liquid connection and with the turbine and pump are a single pump turbine (e.g., pump turbine 33).

Figure 4B:
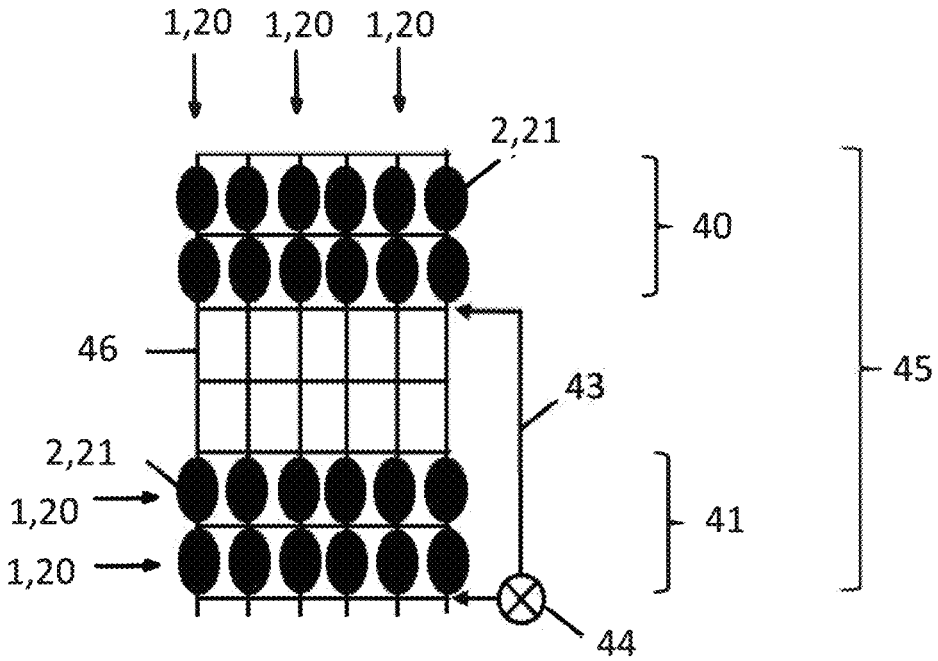
FIG. 4*b* shows a schematic view of an arrangement of liquid storage tanks.
Figure 5:
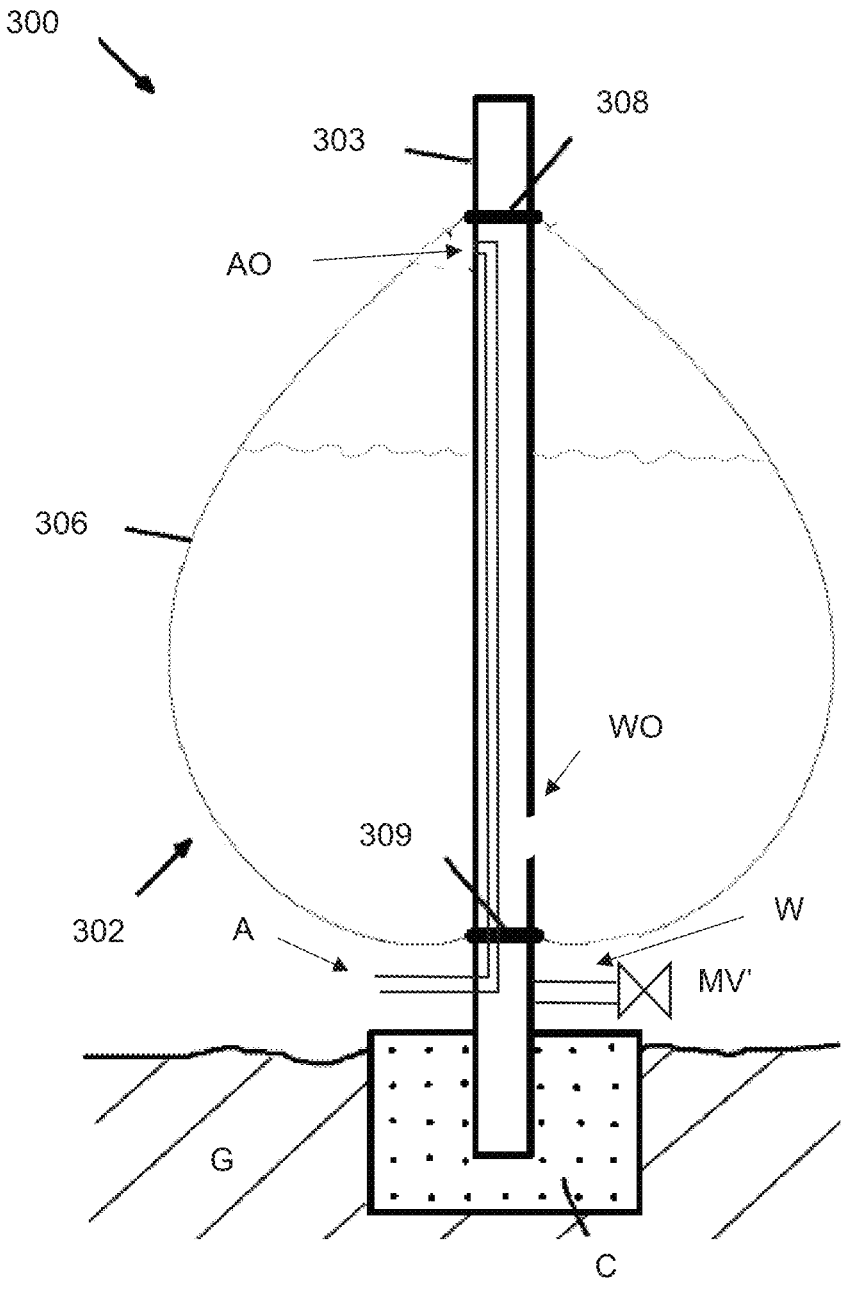
FIG. 5 is a schematic cross-sectional side view of another embodiment of a liquid storage tank.
Figure 6:
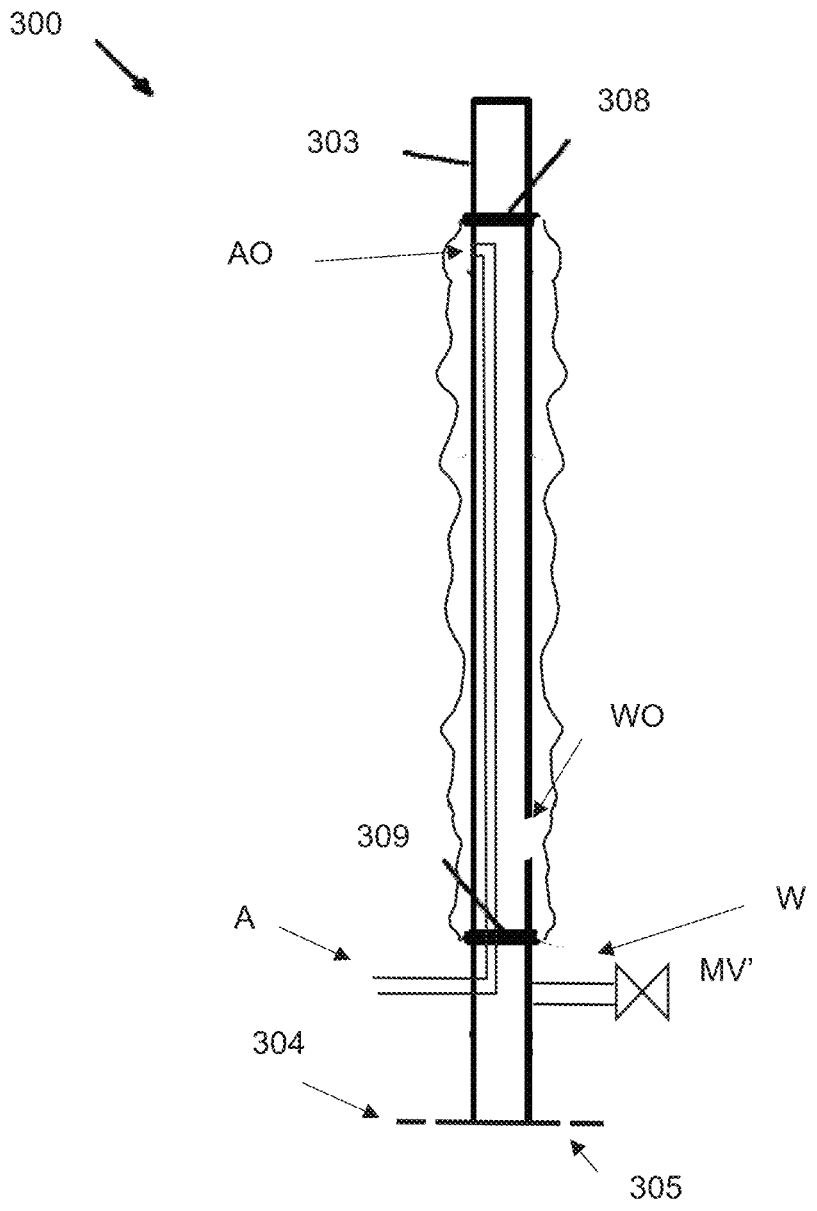
FIG. 6 is a partial schematic cross-sectional side view of the liquid storage tank of FIG. 5.
Figure 7:
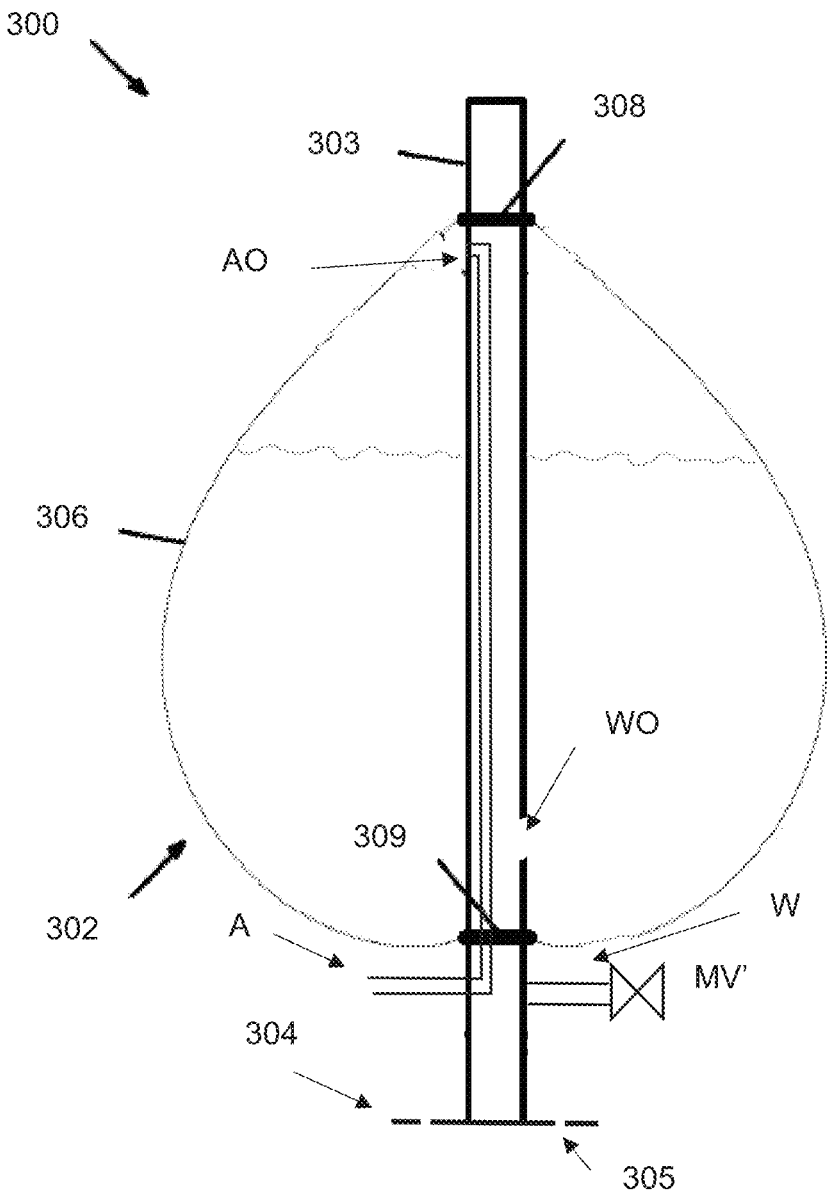
FIG. 7 is a schematic cross-sectional side view of a liquid storage tank.

FIG. 4*b* schematically shows a first group 40 of liquid storage tanks 1, 20 with storage units 2, 21 (see FIGS. 1 and 2) arranged above a second group 41 of liquid storage tanks 1, 20. A conduit arrangement 43 can operatively connect the first groups 40 to the second group 41 via a pump turbine 44. The first groups 40 and the second group 41 are arranged to form a structure 45 (e.g., a building), which has vertical supports 46. The central supports 3 of the liquid storage tanks 1, 20 (see FIGS. 1-2*b*) can be placed on or connected to the vertical supports 46 of the structure 45. Advantageously, placing or connecting the central supports 3 to the vertical supports 46 allows the general shape and orientation of the structure to remain the same or require very little manufacturing or assembly to function as an energy storage system. The structure 45 permits decentralized energy storage (e.g., energy storage via a variety of liquid storage tanks 1, 20) by providing a variety of liquid storage tanks 1, 20 or storage units 2, 21 to provide liquid or pump liquid into (e.g., as pumped storage power plants). Additionally, the lower group 41 can, for example, be replaced by a basin in the foundation of the structure 46. In some examples, the liquid storage tanks 1, 20 are also positioned and coupled to vertical supports 46, therefore moving the liquid storage tanks 1, 20 higher up in the structure 46. Advantageously, the stored water in the structure 46 can also be used as a heat exchanger for heating/cooling the rooms in the structure 46.

In some implementations, a method for energy storage can include at least two storage units (e.g., storage units 2, 21), where one of the storage units is arranged above the other storage unit. A common conduit arrangement 31 is designed such that liquid (e.g., water) can be transferred from one storage unit to the other. Additionally, a pump and a turbine (or a pump turbine 44) is provided in or operatively connected to the conduit arrangement 31. The liquid storage tanks 1, 20 in the first group 40 can be arranged in a building or structure 46. The central supports 3 of each liquid storage tank 1,21 are placed on a vertical support 46 of the structure 46.

FIGS. 5-10 show a liquid storage tank 300. The liquid storage tank 300 can be used in the systems shown in FIGS. 4*a* and 4*b*. Some of the features of liquid storage tank 300 are similar to the features of the liquid storage tanks 1, 20 shown in FIGS. 1-4*b*. Thus, reference numerals used to designate the various components of the liquid storage tank 300 are the same or have similar reference numbers are used to refer to the same or similar features of the liquid storage tanks 1, 20 in FIGS. 1-4*b*. Therefore, the structure and description for the various features of the liquid storage tank 1, 20 and how it's operated and controlled in FIGS. 1-4*b* are understood to also apply to the corresponding features of the liquid storage tank 300 in FIGS. 5-10 except as described below.

The liquid storage tank 300 has a storage unit 302, which is attached to (e.g., suspended from) a central support 303 (e.g., vertical central support, a post). In the example shown in FIG. 5, the central support 303 (e.g., vertical central support, post) is anchored in the ground G (e.g., via concrete C, reinforced concrete). In another example, shown in FIGS. 5-10, a foundation 304 or base is attached to the end of the central support 303 and has openings or holes 305 sized to receive bolts therethrough. The base or foundation 304, and therefore the central support 303 and the liquid storage tank 300, can be bolted to a foundation (e.g., concrete foundation, reinforced concrete foundation) in the ground G. The storage unit 302 has (e.g., includes or consists of) a flexible wall 306 (e.g., membrane) attached to the central support 303 at an upper end, for example via an upper attachment ring 308, and at a lower end, for example via a lower attachment ring 309. The flexible wall 306 or membrane can receive and hold liquid (e.g., water) therein. The flexible wall 306 can be assembled from multiple membrane sections (not shown), The liquid storage tank 300 additionally includes a water connection W with a valve MV' (similar to pump turbine 33, 44) that can be hydraulically connected to, for example, the liquid storage tank 1 (e.g., at the second liquid connection 13) to, for example, deliver liquid (e.g., water) into the flexible wall 306 via opening WO in the central support 303. The liquid storage tank 300 also includes an air line A that can be connected to an air source (e.g. blower) and extends to an opening AO (e.g., in the central support 303) proximate the upper end of the storage unit 302. When filled, the storage unit 302 can have a tear drop shape, as shown for example in FIG. 5. Air is injected, via the air line A, into the top of the storage unit 302 to maintain the flexible wall 306 inflated as the liquid is dispensed from the storage unit 302 (e.g., during a discharging step in the system 1), to advantageously inhibit the flexible wall 306 or membrane section from sagging below the water outlet as liquid is suspended and to allow the liquid at the bottom of the storage unit 302 to be dispensed (e.g., at the first liquid connection 12 or otherwise described herein). Air pressure of a few hundred millibars (e.g., 100 mbar) can be maintained in the storage unit 302. In one example, a blower (see, for example, FIG. 8) delivers air into the storage unit 302 at constant pressure. In another example, the blower varies the pressure of the air delivered into the storage unit 302 (e.g., can increase air flow and pressure as the liquid level drops in the storage unit 302). In one implementation, a central blower is connected to all the liquid storage tanks 300 coupled to a line (e.g., conduit arrangement 31, 43). In another implementation, a central blower is connected to all of the liquid storage tanks 300 in an upper storage section (e.g., first group 40) or a lower storage section (e.g., second group 41). In another implementation, a separate blower is coupled to each liquid storage tank 300. In one example, shown in FIG. 8, a blower unit B can be mounted on top of (e.g. above) the storage unit 302 (e.g., coupled to the central support 303 or vertical central support above the flexible wall 306 or membrane) for each liquid storage tank 300. The blower B can provide an autonomous air inflating system. Optionally, the blower B can be powered by a photovoltaic panel PV and/or battery electrically connected to the photovoltaic panel PV, which can be removably installed in the blower unit B. In another example, the blower B of each liquid storage tank 300 can be powered by a central power source (e.g., that also powers the electric motor/generator EM).

Advantageously the liquid storage tank 300 (e.g., central support 303, storage unit 302, water connection W, valve MV', air line A, base or foundation 304 and/or with the blower B and/or photovoltaic panel PV) can be preassembled and shipped as a single assembled unit, so that it only has to be coupled to the foundation (e.g., bolted to the foundation), the water connection W connected to lines (e.g., conduit arrangement 31,43) and the air line A connected to a blower for the liquid storage tank 300 to be placed into operation. For example, the liquid storage tank 300 can be shipped with the flexible wall 306 collapsed (see FIG. 6), like an umbrella, and expanded (see FIG. 5) once installed and connected to the lines (e.g., conduit arrangement 31, 43) and air source (e.g., blower).

Figure 9:
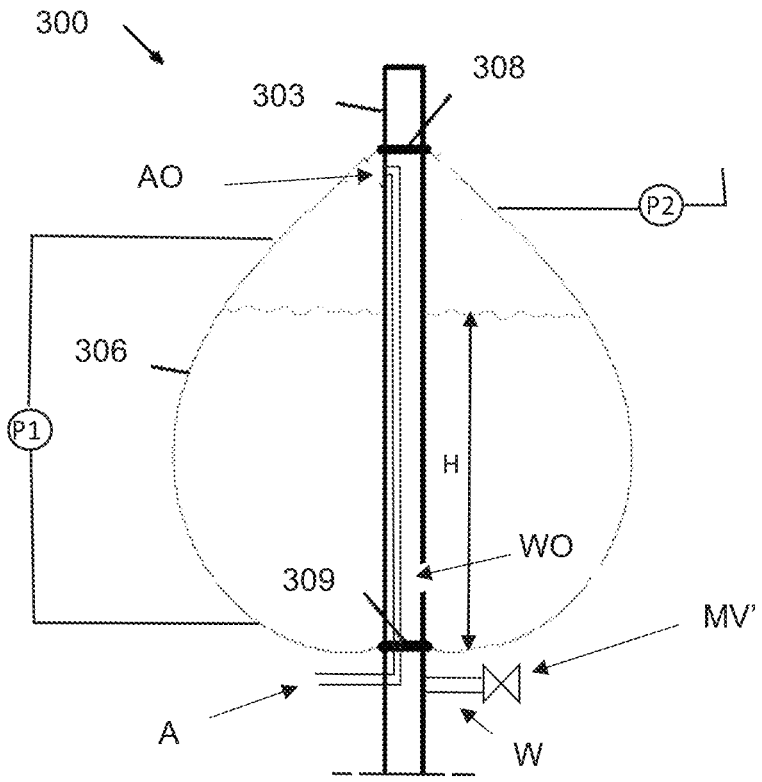
FIG. 9 is a schematic cross-sectional side view of a liquid storage tank.

With reference to FIG. 9, the liquid storage tank 300 can have two pressure sensors P1, P2. One pressure sensor P2 can sense ambient air pressure. The other pressure sensor P1 can sense a pressure differential between the air in the upper end of the storage unit 302 and the liquid in the bottom of the storage unit 302, from which a liquid level H in the storage unit 302 can be computed (and therefore calculate liquid volume in the storage unit 302), which can be used to control the position of the valves MV, MV' of the system 1 (e.g., between varying open positions of the valves MV'). In one example, every liquid storage tank 300 has the pressure sensors P1, P2. In another example, less than all (e.g., only one of the) liquid storage tanks 300 have the pressure sensors P1, P2 (e.g., since all liquid storage tanks 300 on a line (e.g., conduit arrangement 31, 43) are at the same elevation or approximately the same elevation).

Figure 8:
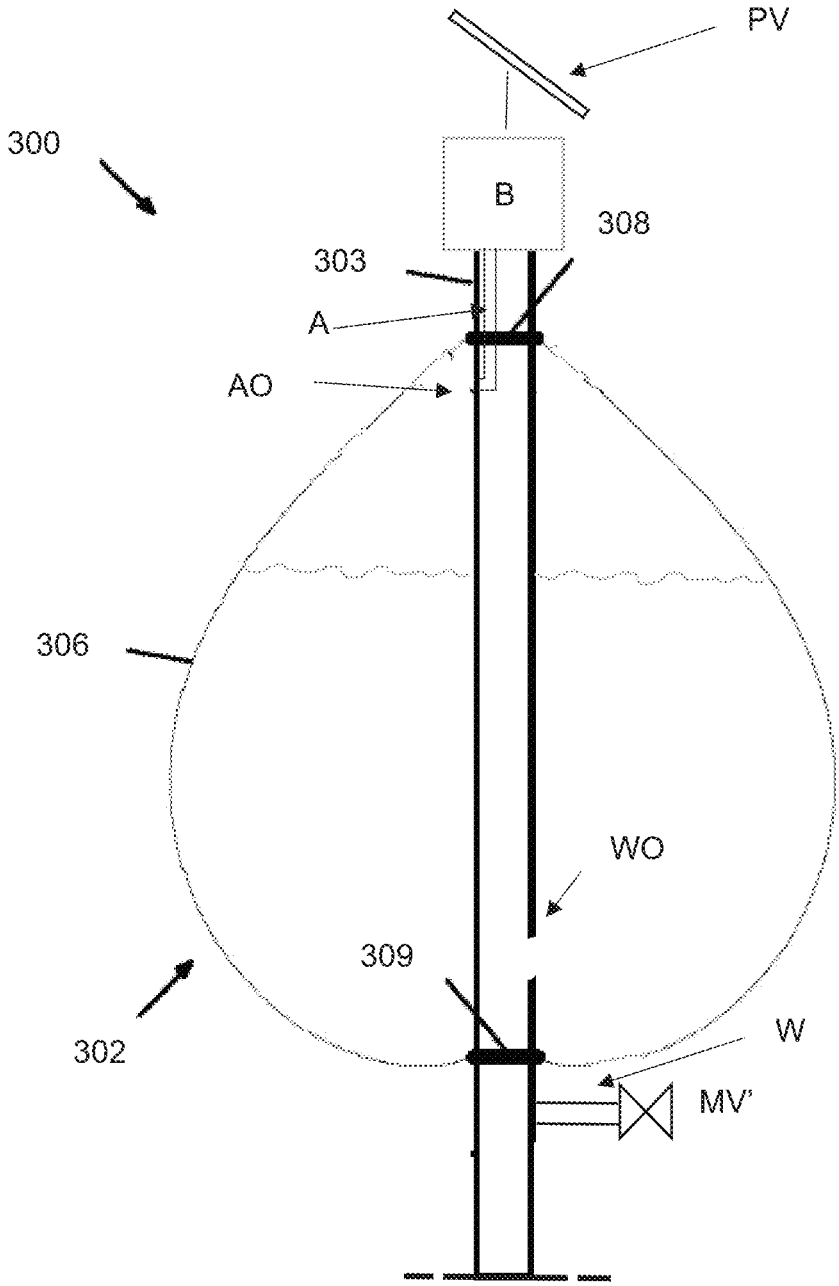
FIG. 8 is a schematic cross-sectional side view of a liquid storage tank.
Figure 10:
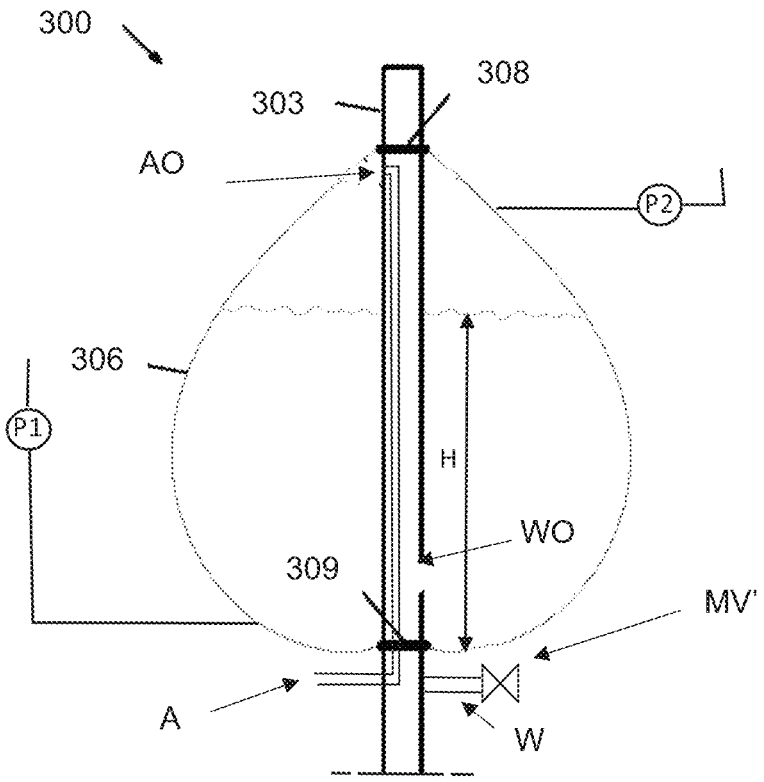
FIG. 10 is a schematic cross-sectional side view of a liquid storage tank.

FIG. 10 shows a liquid storage tank 300 that differs from the one in FIG. 8 only in that the second pressure sensor P1 measures a pressure of air plus liquid at the bottom of the storage unit 302, instead of measuring a pressure differential. In this implementation, the air pressure (provided by ambient pressure sensor P2) is subtracted from the pressure sensed by the first pressure sensor P1 to obtain the pressure provided by the liquid in the storage unit 302, from which the liquid level H in the storage unit 302 can be computed and therefore calculate liquid volume in the storage unit 302), which can be used to control the position of the valves MV, MV' (e.g., between varying open positions of the valves MV'). In one example, every liquid storage tank 300 has the pressure sensors P1, P2. In another example, less than all (e.g., only one of the) liquid storage tanks 300 have the pressure sensors P1, P2 (e.g., since all liquid storage tanks 300 on a line (e.g., conduit arrangement 31, 43) are at the same elevation or approximately the same elevation).

In one implementation, the electronics (e.g., sensors P1, P2, controller for valve MV') of the liquid storage tanks 300 can communicate wirelessly (e.g., WiFi, mesh wireless network) with a controller (e.g., that controls operation of the blower B, operation of the valve MV', operation of the valve MV, etc.). In one example, the controller can be a separate controller for the liquid storage tanks 300. In another example, the controller can be a controller that controls the liquid storage tanks 300 in the upper storage section (e.g., first group 40) and a separate controller that controls the liquid storage tanks 300 in the lower storage section (e.g., second group 41).

Additional Embodiments

In embodiments of the present disclosure, a liquid storage tank for use in an energy storage system, a method for storing energy with a liquid storage tank, and a system for storing energy with liquid storage tanks may be in accordance with any of the following clauses:

Clause 1. A liquid storage tank for use in an energy storage system, comprising: a storage unit configured to expand into a droplet shape when filled with a liquid, the storage unit comprising a flexible wall of a liquid impermeable material assembled from a plurality of membrane sections; a vertical support post coupled to a tip of the flexible wall with an upper attachment ring and coupled to a bottom area of the flexible wall with a lower attachment ring, the upper attachment ring and the lower attachment ring forming a fluid tight seal between the flexible wall and the vertical support post, the flexible wall extending symmetrically about the vertical support post; a first liquid connection port positioned on the flexible wall and proximate to the bottom area, the first liquid connection port being in fluid communication with an interior volume of the storage unit and configured to allow the liquid to flow out of the storage unit; a second liquid connection port positioned on the flexible wall and proximate to the tip, the second liquid connection port being in fluid communication with the interior volume of the storage unit and configured to allow the liquid to flow into the storage unit; an air connection port positioned on the flexible wall, the air connection port being in fluid communication with the interior volume of the storage unit and configured to receive a flow of air therethrough to maintain the flexible wall in an expanded condition as the liquid is withdrawn from the storage unit; and one or more flexible tension members positioned on an outer surface of the flexible wall and extending from the tip to the bottom area, the one or more flexible tension members being configured to exert a pressure along a line of contact between the one or more flexible tension members and the flexible wall to reduce an amount of stress exerted on the flexible wall by the liquid within the storage unit.

Clause 2. The liquid storage tank of Clause 1, wherein the one or more flexible tension members are configured to indent into the flexible wall.

Clause 3. The liquid storage tank any preceding clause, wherein the one or more flexible tension members are configured to exert the pressure along the line of contact between the one or more flexible tension members to form one or more vertically extending ridges between at least two of the one or more flexible tension members and along the flexible wall.

Clause 4. The liquid storage tank of Clause 3, wherein the one or more vertically extending ridges have an arc segment which extends between at least two of the one or more flexible tension members, wherein the arc segment has a curvature radius that is smaller than a curvature radius of a circumference line of the flexible wall, wherein the circumference line is measured when the one or more flexible tension members are operably removed from the outer surface of the flexible wall.

Clause 5. The liquid storage tank of Clause 4, wherein the curvature radius of at least one of the one or more vertically extending ridges is at least 30 percent smaller than the curvature radius of the circumference line.

Clause 6. The liquid storage tank of any preceding clause, wherein the stress along the flexible wall is substantially uniform.

Clause 7. The liquid storage tank of any preceding clause, wherein the one or more flexible tension members are cables.

Clause 8. The liquid storage tank of any preceding clause, wherein the plurality of membrane sections are made of flat sheets.

Clause 9. The liquid storage tank of any preceding clause, wherein the vertical support post is coupled to a foundation positioned on a ground surface.

Clause 10. The liquid storage tank of any preceding clause, wherein the bottom area of the flexible wall is bulged.

Clause 11. The liquid storage tank of any preceding clause, wherein the air connection port is configured to couple to a blower configured to deliver the flow of air to the air connection port.

Clause 12. The liquid storage tank of Clause 11, wherein the blower is configured to be powered by a photovoltaic panel operably connected to the blower.

Clause 13. A liquid storage tank for use in an energy storage system, comprising: a storage unit configured to expand into a droplet shape when filled with a liquid, the storage unit comprising a flexible wall of a liquid impermeable material assembled from a plurality of membrane sections; a vertical support post coupled to a tip of the flexible wall with an upper attachment ring and coupled to a bottom area of the flexible wall with a lower attachment ring, the upper attachment ring and the lower attachment ring forming a fluid tight seal between the flexible wall and the vertical support post, the flexible wall extending symmetrically about the vertical support post; a first liquid connection port positioned on the flexible wall and proximate to the bottom area, the first liquid connection port being in fluid communication with an interior volume of the storage unit and configured to allow the liquid to flow out of the storage unit; a second liquid connection port positioned on the flexible wall and proximate to the tip, the second liquid connection port being in fluid communication with the interior volume of the storage unit and configured to allow the liquid to flow into the storage unit; and an air connection port being in fluid communication with the interior volume of the storage unit and configured to receive a flow of air therethrough to maintain the flexible wall in an expanded condition as the liquid is withdrawn from the storage unit.

Clause 14. The liquid storage tank of Clause 13, wherein a stress exerted along the flexible wall is substantially uniform.

Clause 15. The liquid storage tank of any of Clauses 13-14, further comprising one or more vertically extending ridges having an arc segment which extends between two flexible tension members positioned along the flexible wall, wherein the arc segment has a curvature radius that is smaller than a curvature radius of a circumference line of the flexible wall, wherein the circumference line is measured when the two flexible tension members are operably removed from an outer surface of the flexible wall.

Clause 16. The liquid storage tank of any of Clauses 13-15, wherein the vertical support post is coupled to a foundation positioned on a ground surface.

Clause 17. The liquid storage tank of any of Clauses 13-16, wherein the air connection port is configured to couple to a blower configured to deliver the flow of air to the air connection port.

Clause 18. A liquid storage tank for use in an energy storage system, comprising: a storage unit configured to expand into a droplet shape when filled with a liquid, the storage unit comprising a flexible wall of a liquid impermeable material; a vertical support post coupled to a tip of the flexible wall and coupled to a bottom area of the flexible wall forming a fluid tight seal between the flexible wall and the vertical support post, the flexible wall extending symmetrically about the vertical support post; a liquid connection port being in fluid communication with an interior volume of the storage unit and configured to allow the liquid to flow out of the storage unit and configured to allow the liquid to flow into the storage unit; and an air connection port being in fluid communication with the interior volume of the storage unit and configured to receive a flow of air therethrough to maintain the flexible wall in an expanded condition as the liquid is withdrawn from the storage unit.

Clause 19. The liquid storage tank of Clause 18, further comprising one or more flexible tension members positioned on the flexible wall extending from the tip to the bottom area, the one or more flexible tension members are configured to exert a pressure along a line of contact between the one or more flexible tension members and the flexible wall to reduce an amount of stress exerted on the flexible wall by the liquid.

Clause 20. The liquid storage tank of Clause 19, wherein the one or more flexible tension members are configured to exert the pressure along the line of contact between the one or more flexible tension members to form one or more vertically extending ridges between at least two of the one or more flexible tension members and along the flexible wall.

Clause 21. The liquid storage tank of Clause 20, wherein the one or more vertically extending ridges have an arc segment which extends between at least two of the one or more flexible tension members, wherein the arc segment has a curvature radius that is smaller than a curvature radius of a circumference line of the flexible wall, wherein the circumference line is measured when the one or more flexible tension members are operably removed from an outer surface of the flexible wall.

Clause 22. The liquid storage tank of any of Clauses 18-21, further comprising an upper attachment ring and a lower attachment ring, the upper attachment ring and the lower attachment ring are configured to form a liquid tight seal between the flexible wall and the vertical support post.

Clause 23. The liquid storage tank of any of Clauses 18-22, wherein the liquid connection port is positioned on the vertical support post.

Clause 24. The liquid storage tank of any of Clauses 18-23, wherein the air connection port is positioned on the vertical support post.

Clause 25. The liquid storage tank of Clause 24, wherein the flow of air is configured to flow through the air connection port, upwards through the vertical support post, and out of an air outlet port to deliver the flow of air to an interior portion of the flexible wall.

Clause 26. The liquid storage tank of any of Clauses 18-25, wherein a stress exerted along the flexible wall is substantially uniform.

Clause 27. The liquid storage tank of any of Clauses 18-26, wherein the vertical support post is coupled to a foundation positioned on a ground surface.

Clause 28. A system for storing energy with liquid storage tanks, comprising: one or more storage units configured to expand into a droplet shape when filled with a liquid, the one or more storage units comprising: a flexible wall made of a liquid impermeable material; a vertical support post coupled to a tip of the flexible wall and coupled to a bottom area of the flexible wall forming a fluid tight seal between the flexible wall and the vertical support post, the flexible wall extending symmetrically about the vertical support post; one or more liquid connection ports being in fluid communication with an interior volume of the one or more storage units and configured to allow the liquid to flow out of the one or more storage units and configured to allow the liquid to flow into the one or more storage units; and an air connection port being in fluid communication with the interior volume of the one or more storage units and configured to receive a flow of air therethrough to maintain the flexible wall in an expanded condition as the liquid is withdrawn from the one or more storage units; a group of the one or more storage units fluidly coupled to a conduit, the conduit extending between the one or more liquid connection ports and a pump turbine; wherein the pump turbine pumps the liquid through the conduit and to the group of the one or more storage units through the one or more liquid connection ports; wherein the group of the one or more storage units are operable to deliver the liquid contained within the group of the one or more storage units though the conduit and to the pump turbine to generate electricity.

Clause 29. The system of Clause 28, wherein the group of the one or more storage units are arranged on a hill, wherein the pump turbine is configured to deliver the liquid from a lower elevation to the group of the one or more storage units arranged on the hill at a higher elevation.

Clause 30. The system of any of Clauses 28-29, wherein the group of the one or more storage units includes a combination of storage units, wherein the combination of storage units are each differently sized.

Clause 31. The system of any of Clauses 28-30, wherein the pump turbine is configured to pump the liquid from a large body of water.

Clause 32. The system of any of Clauses 28-31, further comprising a second group of the one or more storage units, wherein the group of the one or more storage units are positioned above the second group of the one or more storage units.

Clause 33. The system of Clause 32, wherein the group of the one or more storage units and the second group of the one or more storage units are arranged to form a structure.

Clause 34. The system of Clause 33, wherein the vertical support post of the one or more storage units are coupled to vertical supports of the structure.

Clause 35. The system of Clause 34, wherein the conduit hydraulically connects the group of the one or more storage units to the second group of the one or more storage units.

Clause 36. The system of Clause 32, wherein the one or more storage units have one or more flexible tension members positioned on the flexible wall extending from the tip to the bottom area, the one or more flexible tension members are configured to exert a pressure along a line of contact between the one or more flexible tension members and the flexible wall to reduce an amount of stress exerted on the flexible wall by the liquid.

Clause 37. The system of any of Clauses 28-36, wherein the one or more liquid connection ports include a first liquid connection port positioned on the flexible wall and proximate to the bottom area and a second liquid connection port positioned on the flexible wall and proximate to the tip.

Clause 38. The system of any of Clauses 28-37, wherein the one or more storage units are coupled to the vertical support post at the tip of the flexible wall with an upper attachment ring and the bottom area of the flexible wall with a lower attachment ring to form the fluid tight seal between the flexible wall and the vertical support post.

Clause 39. The system of any of Clauses 28-38, wherein a flow of air is delivered to an air connection port positioned on the vertical support post to maintain the flexible wall in an expanded condition when the liquid is withdrawn from the one or more storage units.

Clause 40. A method of energy storage with liquid storage tanks, comprising: storing an amount of energy, comprising: pumping a liquid from a lower elevation to a higher elevation through a conduit hydraulically coupled to one or more storage units of one or more liquid storage tanks via liquid connection ports in communication with an interior volume of the one or more storage units, and filling a flexible wall of the one or more storage units with the liquid to store an amount of energy as potential energy, the flexible wall configured to expand and form a droplet shape when filled with the liquid; and generating an amount of electricity, comprising: withdrawing an amount of the liquid from the one or more storage units via the liquid connection ports and flowing the liquid through the conduit away from the one or more storage units to the lower elevation under force of gravity, and rotating a turbine with the liquid flowing through the conduit to generate the amount of electricity.

Clause 41. The method of Clause 40, further comprising delivering a flow of air to an air connection port in fluid communication with the interior volume to maintain the flexible wall in an expanded condition when the liquid is withdrawn from the one or more storage units.

Clause 42. The method of any of Clauses 40-41, further comprising withdrawing the liquid from the one or more storage units via a first liquid connection port of the liquid connection ports, the first liquid connection port positioned proximate to a bottom area of the one or more storage units.

Clause 43. The method of any of Clauses 40-42, further comprising filling the flexible wall of the one or more storage units via second liquid connection port of the liquid connection ports, the second liquid connection port positioned proximate to a tip of the liquid connection ports.

Clause 44. The method of any of Clauses 40-43, further comprising exerting with one or more flexible tension members a pressure along a line of contact between the one or more flexible tension members and the flexible wall to reduce an amount of stress exerted on the flexible wall by the liquid.

Clause 45. The method of any of Clauses 40-44, wherein filling the flexible wall with the liquid includes exerting a substantially uniform stress along the flexible wall with the liquid.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially"" may refer to an amount that is within 10% of the stated amount. As another example, in certain embodiments, the terms "generally parallel" and "substantially parallel" refer to a value, amount, or characteristic that departs from exactly parallel by less than or equal to 10 degrees.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Of course, the foregoing description is that of certain features, aspects and advantages of the present invention, to which various changes and modifications can be made without departing from the spirit and scope of the present invention. Moreover, the devices described herein need not feature all of the objects, advantages, features and aspects discussed above. Thus, for example, those of skill in the art will recognize that the invention can be embodied or carried out in a manner that achieves or optimizes one advantage or a group of advantages as taught herein without necessarily achieving other objects or advantages as may be taught or suggested herein. In addition, while a number of variations of the invention have been shown and described in detail, other modifications and methods of use, which are within the scope of this invention, will be readily apparent to those of skill in the art based upon this disclosure. It is contemplated that various combinations or subcombinations of these specific features and aspects of embodiments may be made and still fall within the scope of the invention. Accordingly, it should be understood that various features and aspects of the disclosed embodiments can be combined with or substituted for one another in order to form varying modes of the discussed devices.

What is claimed is:

1. A liquid storage tank, comprising:

a storage unit configured to expand into a droplet shape, the storage unit comprising a flexible wall of a liquid impermeable material assembled from a plurality of membrane sections;

a vertical support post coupled to a tip of the flexible wall with an upper attachment ring and coupled to a bottom area of the flexible wall with a lower attachment ring, the upper attachment ring and the lower attachment ring forming a fluid tight seal between the flexible wall and the vertical support post, the flexible wall extending symmetrically about the vertical support post;

a first liquid connection port positioned on the flexible wall and proximate to the bottom area, the first liquid connection port being in fluid communication with an interior volume of the storage unit and configured to allow a liquid to flow out of the storage unit;

a second liquid connection port positioned on the flexible wall and proximate to the tip, the second liquid connection port being in fluid communication with the interior volume of the storage unit and configured to allow the liquid to flow into the storage unit;

an air connection port positioned on the flexible wall, the air connection port being in fluid communication with the interior volume of the storage unit and configured to receive a flow of air therethrough to maintain the flexible wall in an expanded condition as the liquid is withdrawn from the storage unit; and one or more flexible tension members positioned on an outer surface of the flexible wall and extending from the tip to the bottom area, the one or more flexible tension members being configured to exert a pressure along a line of contact between the one or more flexible tension members and the flexible wall to reduce an amount of stress exerted on the flexible wall by the liquid within the storage unit.

2. The liquid storage tank of claim 1, wherein the one or more flexible tension members are configured to exert the pressure along the line of contact between the one or more flexible tension members and the flexible wall to form one or more vertically extending ridges between at least two of the one or more flexible tension members and along the flexible wall.

3. The liquid storage tank of claim 2, wherein the one or more vertically extending ridges have an arc segment which extends between at least two of the one or more flexible tension members, wherein the arc segment has a curvature radius that is smaller than a curvature radius of a circumference line of the flexible wall, wherein the circumference line is measured when the one or more flexible tension members are operably removed from the outer surface of the flexible wall.

4. The liquid storage tank of claim 3, wherein the curvature radius of at least one of the one or more vertically extending ridges is at least 30 percent smaller than the curvature radius of the circumference line.

5. The liquid storage tank of claim 1, wherein the stress along the flexible wall is substantially uniform.

6. The liquid storage tank of claim 1, wherein the plurality of membrane sections are made of flat sheets.

7. The liquid storage tank of claim 1, wherein the bottom area of the flexible wall is bulged.

8. The liquid storage tank of claim 1, wherein the air connection port is configured to couple to a blower configured to deliver the flow of air to the air connection port.

9. The liquid storage tank of claim 8, wherein the blower is configured to be powered by a photovoltaic panel operably connected to the blower.

10. A liquid storage tank, comprising:

a storage unit configured to expand into a droplet shape, the storage unit comprising a flexible wall of a liquid impermeable material assembled from a plurality of membrane sections;

a vertical support post coupled to a tip of the flexible wall with an upper attachment ring and coupled to a bottom area of the flexible wall with a lower attachment ring, the upper attachment ring and the lower attachment ring forming a fluid tight seal between the flexible wall and the vertical support post, the flexible wall extending symmetrically about the vertical support post;

a first liquid connection port positioned on the flexible wall and proximate to the bottom area, the first liquid connection port being in fluid communication with an interior volume of the storage unit and configured to allow a liquid to flow out of the storage unit;

a second liquid connection port positioned on the flexible wall and proximate to the tip, the second liquid connection port being in fluid communication with the interior volume of the storage unit and configured to allow the liquid to flow into the storage unit; and an air connection port being in fluid communication with the interior volume of the storage unit and configured to receive a flow of air therethrough to maintain the flexible wall in an expanded condition as the liquid is withdrawn from the storage unit.

11. The liquid storage tank of claim 10, wherein a stress exerted along the flexible wall is substantially uniform.

12. The liquid storage tank of claim 10, further comprising one or more vertically extending ridges having an arc segment which extends between two flexible tension members positioned along the flexible wall, wherein the arc segment has a curvature radius that is smaller than a curvature radius of a circumference line of the flexible wall, wherein the circumference line is measured when the two flexible tension members are operably removed from an outer surface of the flexible wall.

13. The liquid storage tank of claim 10, wherein the air connection port is configured to couple to a blower configured to deliver the flow of air to the air connection port.

14. A liquid storage tank, comprising:

a storage unit configured to expand into a droplet shape, the storage unit comprising a flexible wall of a liquid impermeable material;

a vertical support post coupled to a tip of the flexible wall and coupled to a bottom area of the flexible wall forming a fluid tight seal between the flexible wall and the vertical support post, the flexible wall extending symmetrically about the vertical support post;

a liquid connection port being in fluid communication with an interior volume of the storage unit and configured to allow a liquid to flow out of the storage unit and configured to allow the liquid to flow into the storage unit; and an air connection port being in fluid communication with the interior volume of the storage unit and configured to receive a flow of air therethrough to maintain the flexible wall in an expanded condition as the liquid is withdrawn from the storage unit.

15. The liquid storage tank of claim 14, further comprising one or more flexible tension members positioned on the flexible wall extending from the tip to the bottom area, the one or more flexible tension members are configured to exert a pressure along a line of contact between the one or more flexible tension members and the flexible wall to reduce an amount of stress exerted on the flexible wall by the liquid.

16. The liquid storage tank of claim 15, wherein the one or more flexible tension members are configured to exert the pressure along the line of contact between the one or more flexible tension members and the flexible wall to form one or more vertically extending ridges between at least two of the one or more flexible tension members and along the flexible wall.

17. The liquid storage tank of claim 16, wherein the one or more vertically extending ridges have an arc segment which extends between at least two of the one or more flexible tension members, wherein the arc segment has a curvature radius that is smaller than a curvature radius of a circumference line of the flexible wall, wherein the circumference line is measured when the one or more flexible tension members are operably removed from an outer surface of the flexible wall.

18. The liquid storage tank of claim 14, further comprising an upper attachment ring and a lower attachment ring, the upper attachment ring and the lower attachment ring are configured to form a liquid tight seal between the flexible wall and the vertical support post.

19. The liquid storage tank of claim 14, wherein the liquid connection port is positioned on the vertical support post, wherein the air connection port is positioned on the vertical support post, wherein the flow of air is configured to flow through the air connection port, upwards through the vertical support post, and out of an air outlet port to deliver the flow of air to an interior portion of the flexible wall.

20. The liquid storage tank of claim 14, wherein a stress exerted along the flexible wall is substantially uniform.

* * * * *